United States Patent [19]

DeMatteis

[11] Patent Number: 4,759,639

[45] Date of Patent: Jul. 26, 1988

[54] THERMOPLASTIC BAG

[76] Inventor: Robert B. DeMatteis, 217 Salispuedes, Carmel Valley, Calif. 93924

[21] Appl. No.: 934,554

[22] Filed: Nov. 24, 1986

[51] Int. Cl.[4] ..... B65D 33/10

[52] U.S. Cl. ..... 383/7; 383/9; 383/10; 383/120; 206/554

[58] Field of Search ..... 383/7, 9, 10, 22, 23, 383/33, 120; 206/554

[56] References Cited

U.S. PATENT DOCUMENTS

| | | | |
|---|---|---|---|
| 3,640,450 | 2/1972 | Liberman | 383/9 |
| 4,476,979 | 10/1984 | Reimann et al. | 383/9 |
| 4,493,419 | 1/1985 | Prader et al. | 383/9 |
| 4,595,389 | 6/1986 | Lehmacher | 383/9 |
| 4,613,988 | 9/1986 | Maddock | 383/120 |

*Primary Examiner*—Willis Little

*Attorney, Agent, or Firm*—Jones, Day, Reavis & Pogue

[57] ABSTRACT

The present invention relates to thermoplastic bags which are characterized by two perforated tabs symetrically attached to the front and back walls at the mouth of the bag. Using a sculptured bag or any of several thermoplastic bag structures currently in use (handled or flush-cut; gussetted or flat), the configuration of the two tabs is such that it enables the user to easily open and load the bag while the mouth remains open and the bag in place. Additionally, the placement of the two tabs permits easy loading of a unitary pack on dispensing holders, including armless stands, resulting in more efficient use of time and space by retail users. The placement and scallop design of the tab perforations create stress transfer tips which distribute stress away from creases and slit-seals at the open mouth, preventing tearing or zippering at the mouth of the bag where stress concentration is most likely and permitting greater use of slit-seals and corresponding reduced costs of manufacture.

9 Claims, 4 Drawing Sheets

FIG. 1
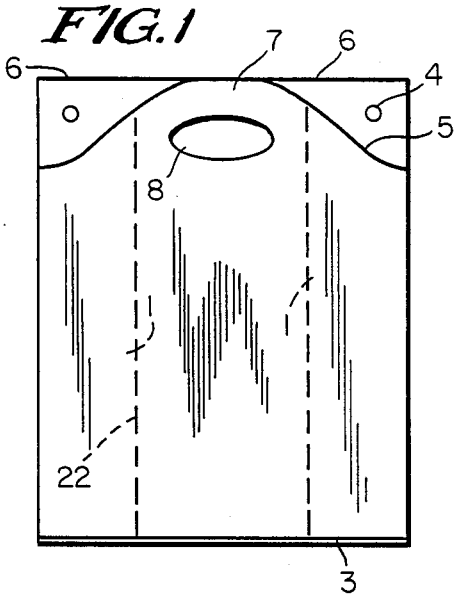
FIG. 1A
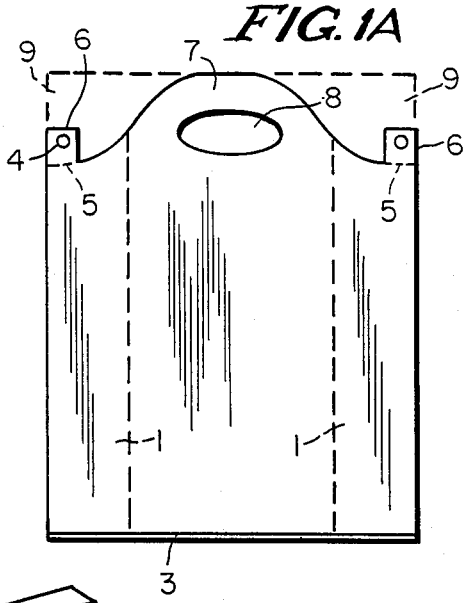
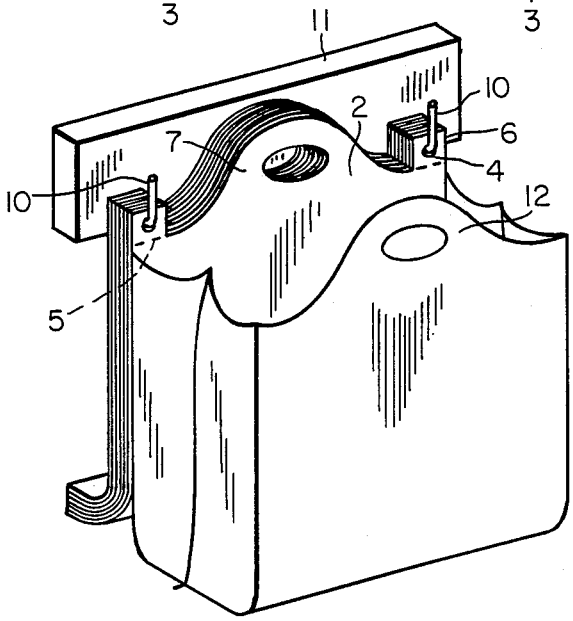
FIG. 1B
FIG. 2
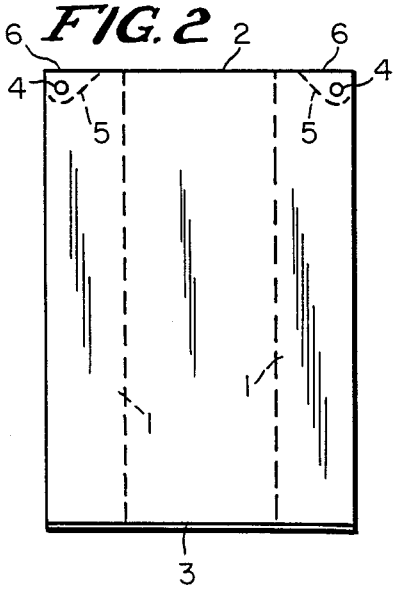
FIG. 2A
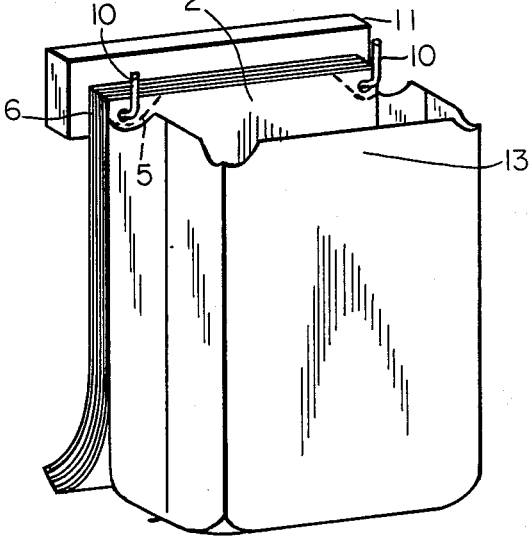

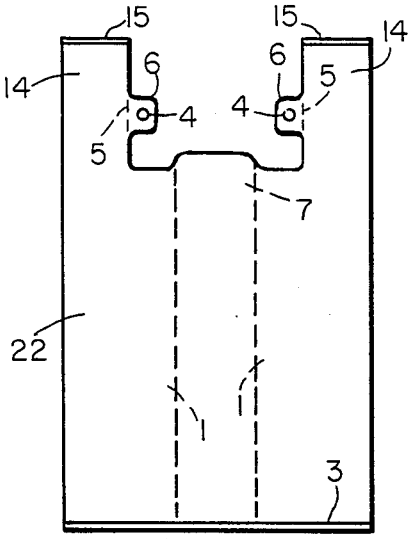
FIG. 3
FIG. 3A
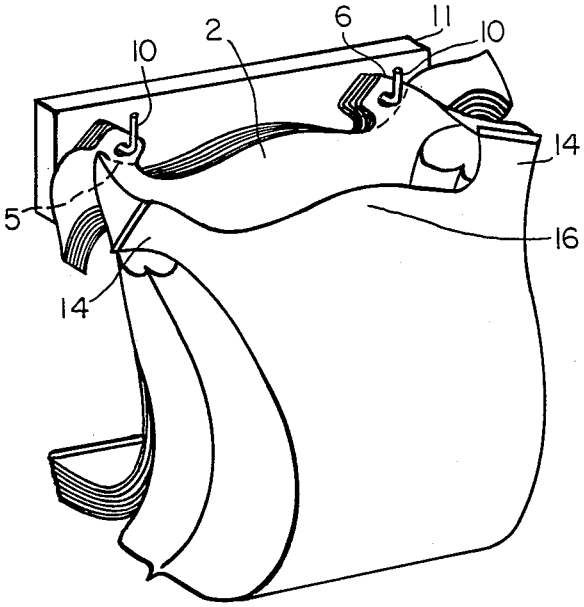
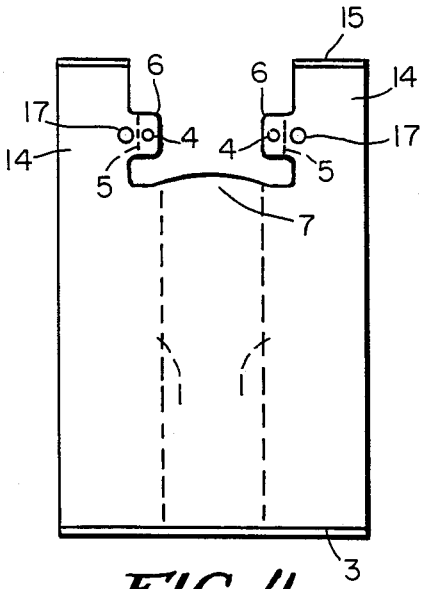
FIG. 4
FIG. 4A
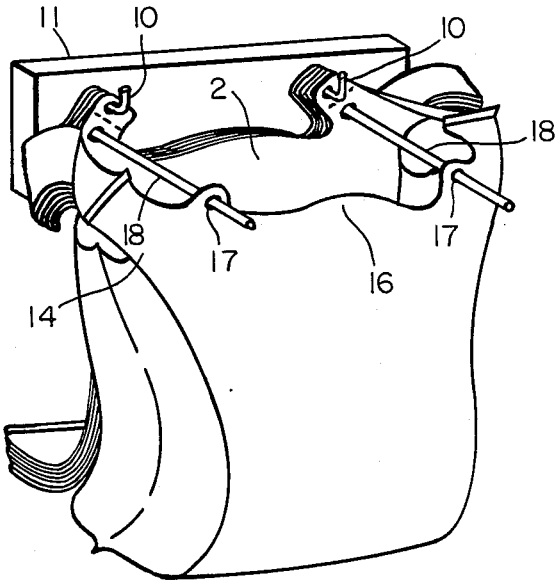

FIG. 5
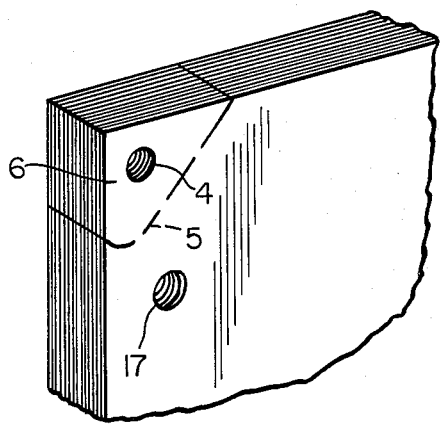
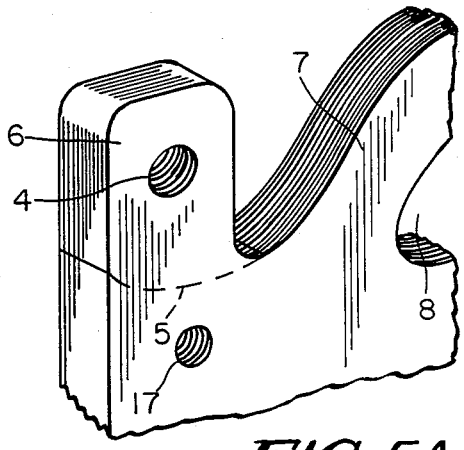
FIG. 5A
FIG. 5B
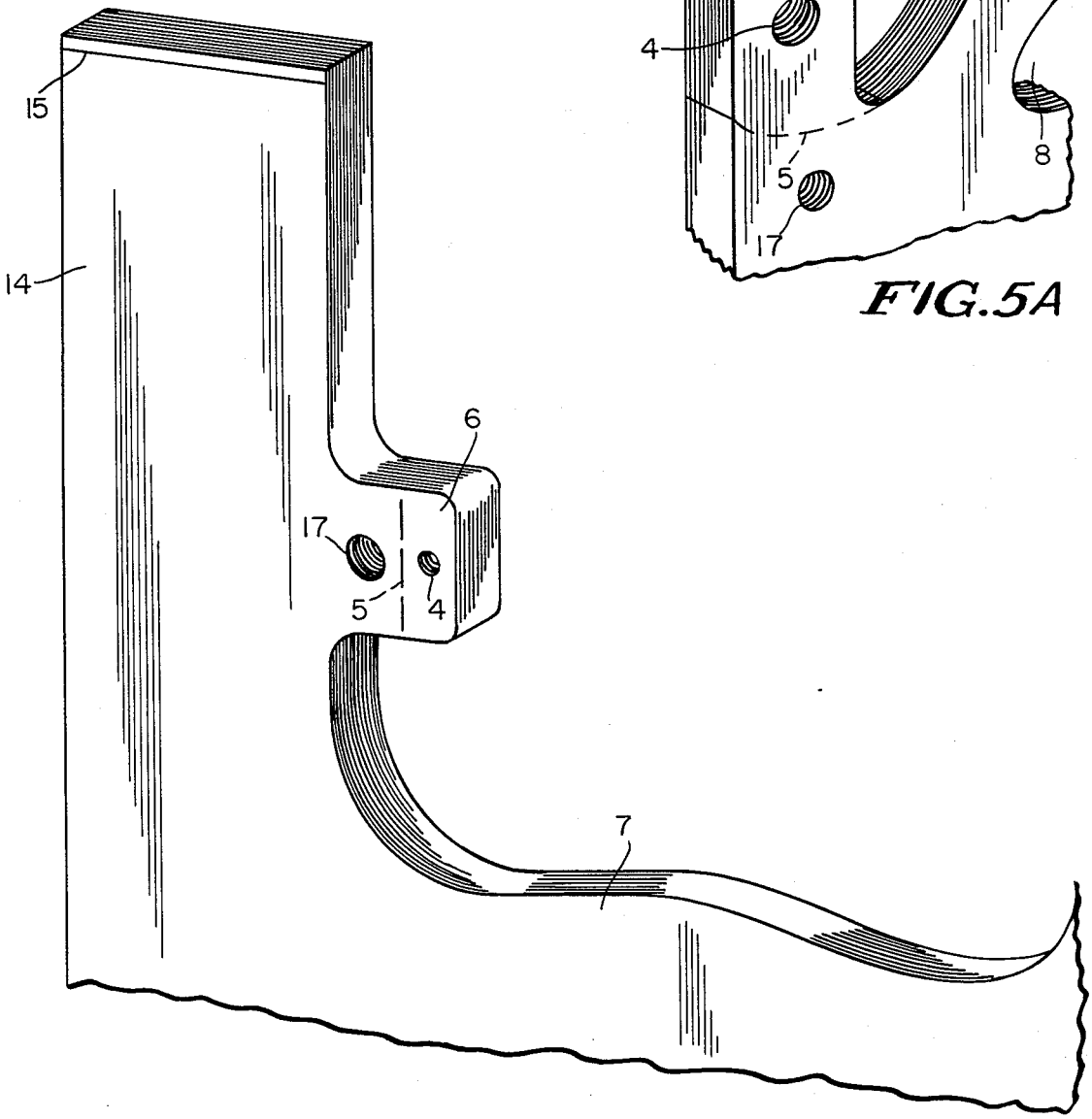

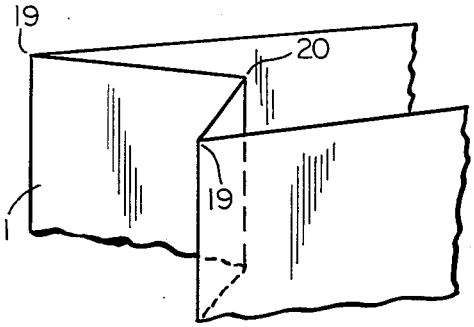
FIG. 6
FIG. 6A
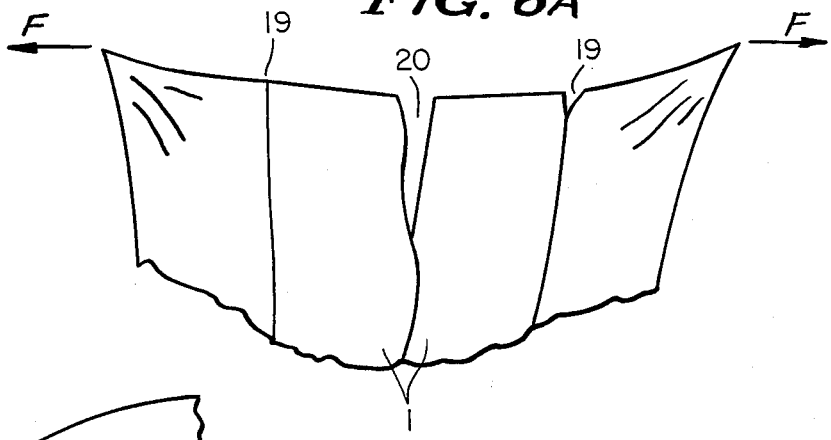
FIG. 7
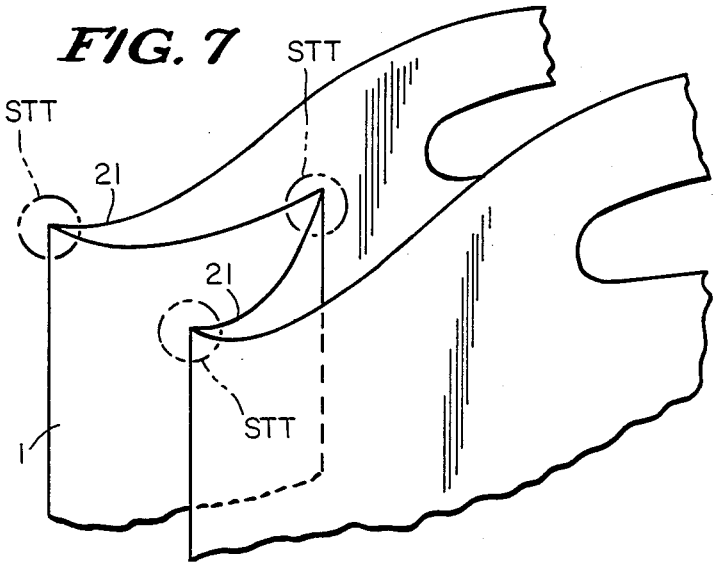
FIG. 7A
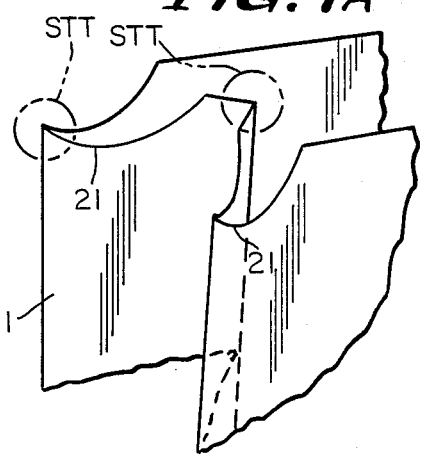
FIG. 7B
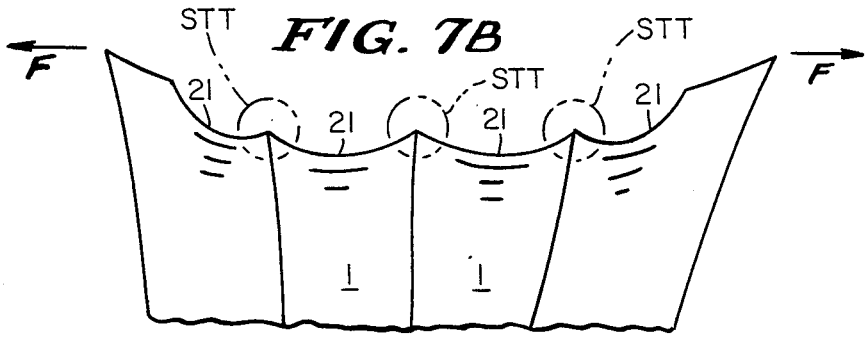

THERMOPLASTIC BAG

FIELD OF INVENTION

The present invention relates to all thermoplastic bag structures currently in use, including sculptured-top, flush-cut, and T-shirt style handle bags and thermally welded unitary packs thereof. The bag structure is specially designed with two perforated tabs to facilitate easy opening and loading by the user. The bags may be manufactured on modern high speed bag equipment for maximum per unit cost effectiveness. Furthermore, the structure and placement of the tab perforations distributes stress concentration away from creases and slit-seals at the mouth of the bag, thus reducing zippering or tearing at the creases or slit-seals of side gussetts.

DESCRIPTION OF PRIOR ART

In the past, flush cut style plastic bags used in retail and grocery applications were typically packaged in cardboard cartons, or on continuous rolls. The user would need to withdraw or tear off a single bag, separate the walls with two hands, open, and then load the bag. Static cling at the bag mouth causes additional inefficiency. These plastic bags did not utilize any detachable tabs for loading onto dispensing racks. The process of using plastic bags in a higher volume store, where fast customer checkout is important, places a premium on handling time. More expensive paper bags are easier and faster to use than these prior art plastic bags, because paper bags are easy to open and will stand upright and stay open while they are being packed.

Other flush cut style plastic bags are manufactured in very thick gauges in order to have a bag stand upright like the paper bag version. This significantly increases raw material costs making them too expensive for the high-volume users, and does not address the problem of more efficient opening for use. Another design is a wicketed bag which comprises a u-shaped wire or u-bolt fastened at the top of the plastic bag pack to secure same to a loading rack. This design is not cost effective in most retail and grocery applications with the current manufacturing processes. The wicket and extra attachments required render the bag making process slow with only one or, sometimes two, bags produced per cycle. This bag making process cannot be applied to the more versatile and desirable side-gusseted bags without a tremendous increase in costs.

The successful introduction of the thinner-gauged, cost effective T-shirt or handle style plastic bag is directly related to the use of a dispensing rack with extended arms enabling the mouth of the bag to be held open while loading. These prior art bags, in some configurations, utilized one perforated tab located at the center of the bag mouth, which tab had the function of mounting the unitary pack on the dispensing rack. These rack dispensers are somewhat difficult to use and good manual dexterity is required in order to stretch the handles over the arms. This is time-consuming with employee training and practice required for minimally efficient use. A further disadvantage of the prior art handle bag structure is that the arms of the rack interfere with the loading of product into the bag and take up considerable space on the loading counter.

The prior manufacturing process of T-shirt style bags (U.S. Pat. No. 3,358,904) presented certain problems of stress concentration in the bag mouth area where tearing or zippering can occur when handles are stretched over arms in dispensing racks or when the bag is placed under load. This problem can be reduced by applying prior invention of U.S. Pat. No. 4,165,832 regarding "stress relief notches". Not resolved is the problem of the tearing of bag sides at the creases of the side gussets. This occurs prior to placing the bag under load, when the handles are stretched over the dispenser rack's arms for loading.

SUMMARY OF INVENTION

The bag structures of the present invention substantially improve the efficiency with which thermoplastic bags may be placed in use, thereby eliminating the disadvantages of prior art thermoplastic bag structures. The design and placement of the detachable tabs permits the user to open the bag quickly with one hand. The open mouth portion of the bag then automatically remains open to its full breadth while the user is able to use one or two hands to load objects into the bag. In a flush cut plastic bag, the present invention eliminates the costly manufacturing process of using wickets. In a T-shirt bag, the present invention additionally saves space and time by eliminating the need for dispensing rack systems with arms. Minimum dexterity and training by the user is needed. Further, the open mouth portion of the present bag structures are especially designed to distribute stress concentration away from the vulnerable creases and slit-seals, where the bag is most likely to tear. The present invention can be effectively produced on high-speed, bottom seal bag machines at two to four or even more bags per cycle, thus improving the economics of manufacturing.

BRIEF DESCRIPTION OF THE DRAWINGS

FIGS. 1, 1-A, and 1-B show the present invention of a sculptured plastic bag with die cut handle in two designs, with a schematic representation of a bag in use.

FIGS. 2 and 2-A show the present invention of a flush cut bag, with a schematic representation of a bag in use.

FIGS. 3 and 3-A show the present invention of a T-shirt bag, with a schematic representation of a bag in use.

FIGS. 4 and 4-A show the present invention of a T-shirt bag which is characterized by tab extensions containing optional retainer holes, with a schematic representation of said bag in use.

FIGS. 5, 5-A, and 5-B show a perspective view of a unitary pack of each of the bag structures illustrated in FIGS. 1-A, 2, and 4, respectively, with focus on the perforated tab in each structure (optional retainer holes are shown).

FIGS. 6 and 6-A show a schematic representation of a prior art bag structure and the stress points thereof.

FIGS. 7, 7-A and 7-B show schematic representations of present bag structures and the stress points thereof.

DESCRIPTION OF SPECIFIC EMBODIMENTS

The bag structures of the present invention (e.g., FIG. 1, sculptured top; FIG. 2, flush cut; or FIG. 3, T-shirt) are generally comprised of, and fabricated from, a flattened plastic tube. This tube may be flat or gusseted. The bags are comprised of an open mouth portion (2) at, or near, the top, and a thermally sealed bottom (3) which creates the bag's purse, when loaded. The present invention is equally efficacious with flat or gusseted side walls, with or without slit-seals. The gusseted styles are characterized by side edges of the bag structure which comprise inwardly folded gussets (1) allowing for bag expansion during loading.

Slit-seals are produced by a flattened tube, twice as wide as is required for the bag width, cut (or slit) into two tubes, side by side, in the width desired. This slitting is done by a hot, sharp, blade that reseals the two tubes simultaneous to the cutting process. This operation produces a slit-seal bag, which is to be distinguished from a more expensive tube type or seamless bag without slit-seals. The slit-seal process may also be done to convert a large tube into multiples of 3, 4, and even more smaller tubes when deemed desirable. Slit seals are usually located at the center crease on the side gusset (20) or on the outside crease of a flat bag. As will be more particularly described herein, the present invention permits wider use of the slit-seal operation.

The bags are formed into convenient unitary packs for shipping and loading onto dispensing holders. This can be done by stacking the bags into a pre-determined plurality, and then assembling them into a unitary pack by penetrating the stack with a heated blade or punch element which heat-welds them together to form apertures (4) located on the outside corners of the bag mouth. In the T-shirt style handled bag, the apertures (4) are formed at a location toward the upper central portion of the bag that will line up with the dual tabs (6). A cut-out operation then cuts the perforation (5), forming the dual detachable tabs (6). The same cut-out operation can shape the mouth of the bag to form the sculptured top or the T-shirt style handles.

One form of the present invention is the sculptured bag as shown in FIGS. 1, 1-A, 1-B and 5-A. During the cut-out process, in which the perforations (5) and the dual tabs (6) are created, the sculptured top is formed. The rise in the middle of the bag (7) created in this process may or may not include a die-cut handle (8). During this cut-out process, it may be desirable to cut away the corners (9) and recycle this material to realize an extra cost savings. The apertures (4) are utilized to mount the two detachable tabs (6), onto supporting hooks (10), or similar elements of a bag holder (11). The holder serves to suspend and support the individual unitary pack above a counter-top or loading surface.

Use of the bag is greatly facilitated by the present invention as follows: The user pulls open and forward at the die-cut handle on the front wall of the forwardmost bag (12). The front wall and side gusset walls separate from the dual tabs (6) at the perforations (5) leaving the rear wall tabs intact. Thus the rear wall is supported by the two rear tabs, preventing the rear and side bag walls from collapsing inwards. This structure allows the bag mouth (2) to open to it's widest extent for quick and easy top loading, while the front wall naturally holds in place without the need to maintain a hand on the said front wall. When loading is completed, the loaded bag is pulled forward and rear wall then separates from the dual tabs (6) at the perforations (5). It is to be noted that other configurations of one or two tabs at the center or toward the center of the bag mouth, as utilized in prior art, does not suffice to hold up the outer side walls of the bag or permit the bag mouth to open to it's widest extent.

A second form of bag structure of the present invention, as shown in FIGS. 2, 2-A and 5, is the flush cut style. Manufactured in the same manner as described above, it differs from the sculpture-top bag only in that the top is straight across the open mouth, with perforated tabs cut-out at the outer corners. The apertures (4) are utilized to mount the dual, detachable tabs (6) onto supporting hooks (10), or similar elements on a bag holder (11).

Loading operations are the same as in the sculptured bag: the user pulls open and forward the top-center of the front wall (13) of the forwardmost bag with one hand. The front bag wall and side gusset walls separate from the dual tabs (6) at the perforations (5). The rear wall remains intact, thus supporting the bag by preventing the rear and side bag walls from collapsing inward. When the loading is completed, the loaded bag is pulled forward and rear wall then separates from the dual tabs (6) at the perforations (5).

A third form of bag structure of the present invention is shown in FIGS. 3, 3-A, 4, 4-A, and 5-B, and is commonly referred to as a T-shirt style bag. The T-shirt style bag is distinguished by handles (14) attached to, and a part of, the front, rear, and inwardly folded side-gusseted walls. Unlike the flush cut style bag, the T-shirt style is also thermally sealed along the top edge (15) to create the closed handle (14) in a similar fashion as it is sealed along the bottom edge (3). When utilized, slit-seals at the sides are produced in the same manner as the previous two bag structures. The two detachable tabs (6) of the present invention are located on the inner periphery of the bag mouth, at or near the mid-point between the top of the handles and the bottom of the open mouth potion. Apertures (4) are formed by heated blade or punch elements as in the other bag structures, and the two detachable tabs with perforations (5) are formed during the cut-out process. The apertures (4) are utilized to mount the dual, detachable tabs onto supporting hooks (10) or similar elements on a bag holder (11). Hooks (10) are spaced far enough apart to allow the handles to lay outwardly when the unitary packs are mounted on the holder.

During the loading operation (FIG. 3-A), the user pulls open and forward the top-center (16) of the front wall of the forwardmost bag. The front bag wall and side gussset parts of the handles (14) separate from the dual tabs at the perforations (5). The rear wall remains intact with the dual tabs thus supporting the bag while the handles (14) lay outwards. This, together with the support at the dual tabs, prevents the rear, front and side bag walls from collapsing inward. The bag mouth (2) will automatically open wide (FIG. 3-A) for quick and easy top loading, as in the previous bag structures. It is to be noted that placement of one or two tabs at or near the top of the handles, or on the outside of the handles, cause the bag mouth to be restricted in opening. Tabs placed on the outside cause bag handles to fall inward and the bag to collapse. Tabs placed high on the handles cause the bag mouth opening to be restricted, and side walls have insufficient support to enable the bag mouth to naturally remain open. A single tab in the center of the bag mouth, as is widely used in prior art U.S. Pat. No. 4,165,832), also restricts bag opening and provides no support to prevent the side walls from collapsing inwardly. A dispensing rack with extended arms over which handles are stretched is required for this bag structure.

Extension arms on a holder are not required with the present invention as there is a natural tendency for the bag to stand up and open when the front wall is detached from the holder. However, for certain circumstances such as top-heavy articles for loading, it may be desirable to have additional support of the bag walls provided by optional rod holders as shown in FIGS. 5, 5-A, 5-B, 4 and 4-A. In this event, the present invention may be comprised of additional retainer holes (17) in FIGS. 5, 5-A, and 5-B) to accept rod holders. These retainer holes (17) are formed by a cold hole-punch element such that the peripheral area of the aperture are not fused together, thus permitting free movement to the front bag wall along the rod holder during the bag opening operation. The retainer holes are located near, but on the inside or bag-side of, the tab perforations to provide easy mounting onto rod holders ((18) in FIG. 4-A). On a flush cut or sculptured bag (FIGS. 5 and 5-A respectively) they are punched through the front, side, and rear walls, during the cut-out operation, as far outward as possible to limit the rod holders interference with the loading process. On the T-shirt style bag FIG. 5-B) the tabs are extended further away from the handles during the cut-out process and the retainer holes are cut-out in the extended portion of the tab, between the perforation and the handle structure. Thus the rod holders may be utilized as necessary without the cumbersome operation of stretching the handles over support arms as in prior art bags.

In accordance with one aspect of the present invention, removal of the individual bag from the dual tabs results in the formation of upwardly extending tips, called stress transfer tips (STT), as shown on FIG. 7. These tips are actually formed in the cut-out of the perforation (5) for the dual tab (6). The point of each STT is located on the crease and/or slit-seal of the bag side at the open mouth portion. The function of the stress transfer tip is described in detail hereinafter.

As shown on FIGS. 6 and 6-A, the most vulnerable stress locations on a prior art bag are at the top of the gusset or side creases (19) and at the top of the slit-seal (20) along the inward center crease of the side gusset. Because of vulnerability to force F, manufacturers of thermoplastic bags do not utilize the more cost efficient slit-seal to the maximum extent desirable.

The bag structure of the present invention is characterized by cutting the perforations in a "scalloped" shape (5) at the tabs (6), as shown on FIGS. 1 and 2. When the front wall of the bag is pulled open, resulting in the application of force F, the stress transfer tips thereby formed transfer the stress from the apex of the crease or slit-seal to the less vulnerable panels between the creases (21), thus reducing the incidence of tearing in the side wall or side gusset.

Stress transfer tips of the present invention are formed in the T-shirt bag structure by the rise in the top middle portion of the bag mouth ((7) of FIGS. 4 and 5). The side gusset panels are made wider than the handles (14) so as to extend the center crease of the side gusset panels (22) to a point along the upward rising curve of the rise in the bag mouth. The stress transfer tip on the center crease is then formed when the bag mouth is cut out. The stress transfer tips function in the same fashion as other bag structures to transfer stress away from the center crease or slit-seal when force F is applied during the opening operation.

In accordance with another aspect of the present invention, a rise in the top middle portion of the front and rear wall of the open bag mouth (7) is provided during the cut-out process. As shown on FIGS. 1, 3 and 4, this rise at the center enhances the ability of the user to quickly grasp the outer or front wall of the bag to pull open for use.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A thermoplastic bag comprising a front bag wall and a rear bag wall and an open mouth portion, said bag having perforated tabs symetrically placed at opposite outer corners of the open mouth portion, the perforated tabs having a hole therethrough, the front and rear bag walls having handle aperture therethrough for use in grasping the bag, the handle aperture located between the tabs said tab perforations being cut out in a scalloped shape to form stress transfer tips at the opposite ends of the open mouth.

2. A thermoplastic bag structure in accordance with claim 1 wherein said front and rear walls are joined together by an intergral pleat portion.

3. A thermoplastic bag structure as recited in claim 1 being characterized by having a hole located near the perforation of each tab, which hole is capable of accepting rod holders.

4. A thermoplastic bag structure as recited in claims claim 1 being characterized by having a curved rise at the center of the open mouth.

5. A thermoplastic bag comprising a front bag wall and a rear bag wall joined at a bottom and at side pleat portions, the bag walls defining an open mouth portion and also defining handles located on opposite sides of the open mouth portion, the bag walls having a curved rise between the handles, the side pleat portions folded substantially into the curved rise between the handles wherein the corresponding curve in the pleat portions forms stress transfer tips.

6. The thermoplastic bag of claim 5 further comprising tabs on the inner periphery of the handles.

7. The thermoplastic bag of claim 6 wherein said tabs are detachable from the handles at perforations.

8. The thermoplastic bag of claim 7 wherein the tabs are located approximately half-way between the top of the handles and the open mouth portion.

9. A thermoplastic bag structure as recited in claim 7 wherein said tabs are characterized by having an extended portion between the perforation and the handle, which extension is characterized by a hole, which hole is capable of accepting rod holders.

* * * * *

UNITED STATES PATENT OFFICE

CERTIFICATE OF CORRECTION

Patent No. 4,759,639 Dated July 26, 1988

Inventor(s) DeMatteis et al

It is certified that error appears in the above-identified patent and that said Letters Patent are hereby corrected as shown below:

On the Title Page, Item [76]

Add to the list of inventors on the face of the patent the following name and address:

Louis J. Abrahams
4 St. Ninians Road
Brighton, 3186
Australia

Signed and Sealed this

Fifteenth Day of November, 1988

*Attest:*

DONALD J. QUIGG

*Attesting Officer*

*Commissioner of Patents and Trademarks*